US009845671B2

(12) United States Patent
Kpetehoto et al.

(10) Patent No.: US 9,845,671 B2
(45) Date of Patent: Dec. 19, 2017

(54) EVALUATING A CONDITION OF A DOWNHOLE COMPONENT OF A DRILLSTRING

(71) Applicant: Baker Hughes Incorporated, Houston, TX (US)

(72) Inventors: Franck T. Kpetehoto, Houston, TX (US); Donald Keith Trichel, Houston, TX (US); Abdallah Ahmed ElKamel, Spring, TX (US); Sandeep S. Janwadkar, The Woodlands, TX (US); Sridharan Chandrasekaran, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 676 days.

(21) Appl. No.: 14/028,387

(22) Filed: Sep. 16, 2013

(65) Prior Publication Data

US 2015/0075274 A1 Mar. 19, 2015

(51) Int. Cl.
*E21B 47/007* (2012.01)
*E21B 47/00* (2012.01)

(52) U.S. Cl.
CPC ..... *E21B 47/0006* (2013.01)

(58) Field of Classification Search
CPC ..... E21B 47/0006
See application file for complete search history.

(56) References Cited

U.S. PATENT DOCUMENTS 6,021,377 A * 2/2000 Dubinsky ..... E21B 7/068 702/9
6,662,645 B2 12/2003 Brewer
6,679,323 B2 1/2004 Vargervik et al.
6,954,679 B1 10/2005 Takeda et al.
(Continued)

OTHER PUBLICATIONS

Majumdar, Barun Kanti, "Drill Pipe Fatigue Analysis in Offshore Application," Texas Tech Thesis (Dec. 1986).
(Continued)

*Primary Examiner* — R. A. Smith
*Assistant Examiner* — Herbert K Roberts
(74) *Attorney, Agent, or Firm* — Mossman, Kumar & Tyler, PC

(57) ABSTRACT

Methods, systems and products for evaluating a downhole component condition for a drilling assembly in a borehole. Methods include estimating a bending moment on the component at a selected depth along the borehole; estimating a number of rotations of the component at the selected depth; and estimating the condition of the component using the estimated bending moment and the estimated number of rotations at the selected depth. Estimated bending moment may be derived from a borehole model using an estimated deviation on a selected length of the borehole about the selected depth. The condition may be accumulated fatigue or estimated remaining useful life. Estimating the condition may include tracking a total estimated number of rotations wherein the component is subjected to bending moment values in a corresponding moment window, which may be
(Continued)

greater than a predetermined threshold bending moment. Weight factors may be associated with at least one moment window.

15 Claims, 6 Drawing Sheets

(56) References Cited

U.S. PATENT DOCUMENTS

| | | | | |
|---|---|---|---|---|
| 7,412,368 | B2 | 8/2008 | Mitchell | |
| 7,571,643 | B2 * | 8/2009 | Sugiura | E21B 7/062 73/152.46 |
| 8,265,915 | B2 | 9/2012 | Hsu et al. | |
| 2004/0221985 | A1 | 11/2004 | Hill et al. | |
| 2005/0279532 | A1 | 12/2005 | Ballantyne et al. | |
| 2011/0077924 | A1 | 3/2011 | Ertas et al. | |
| 2012/0016589 | A1 | 1/2012 | Li et al. | |
| 2012/0046865 | A1 | 2/2012 | Heisig et al. | |
| 2012/0130693 | A1 | 5/2012 | Ertas et al. | |
| 2013/0041586 | A1 | 2/2013 | Schuberth et al. | |

OTHER PUBLICATIONS

Zafar, Raja Hamayun, "North Sea Data Yield Insight on Fatigue Lift of Drill Pipe," Oil & Gas Jnl, vol. 105, Issue 2 (7 pp.) (Jan. 8, 2007).

* cited by examiner

EVALUATING A CONDITION OF A DOWNHOLE COMPONENT OF A DRILLSTRING

FIELD OF THE DISCLOSURE

In one aspect, this disclosure relates generally to drilling a borehole in an earth formation. More particularly, this disclosure relates to methods, devices, and systems for evaluating a condition of a downhole component of a drillstring.

BACKGROUND OF THE DISCLOSURE

Geologic formations are used for many purposes such as hydrocarbon production, geothermal production and carbon dioxide sequestration. Boreholes are typically drilled into an earth formation in order to intersect and/or access the formation. Various types of drillstrings may be deployed in a borehole. A drillstring, also known as a drilling assembly, generally includes components, such as those making up a drill pipe or a bottomhole assembly. The bottomhole assembly contains drill collars which may be instrumented and can be used to obtain measurements-while-drilling or -while-logging.

Some drillstrings can include components that allow the borehole to be drilled in directions other than vertical. Such drilling is referred to in the industry as "directional drilling." While deployed in the borehole, the components of the drillstring may be subject to a variety of forces or strains.

Trajectory changes, either planned (i.e., directional drilling) or unplanned (e.g., azimuthal walk), may result in the creation of a non-linearity (or deviation) in the borehole, such as a dogleg. A dogleg is a section in a borehole where the trajectory of the borehole changes, e.g., drillbit inclination or azimuth changes. This trajectory change may introduce or alter a rate of curvature over a length of the borehole. One measure of the rate of curvature (or rate of trajectory change) may be referred to as dogleg severity ('DLS'). DLS may be measured between consecutive survey stations along the wellbore trajectory.

SUMMARY OF THE DISCLOSURE

In aspects, the present disclosure is related to evaluation of a condition of a downhole component of a drillstring in a borehole intersecting an earth formation.

Method embodiments may include estimating a bending moment on the component at a selected depth along the borehole; estimating a number of rotations of the component at the selected depth; and estimating the condition of the component using the estimated bending moment and the estimated number of rotations at the selected depth. The method may further include deriving the estimated bending moment using an estimated deviation on a selected length of the borehole about the selected depth. Deriving the estimated bending moment may include deriving the estimated deviation from a borehole model and/or from dimensions of the component. The method may further include deriving the estimated location of the component in the borehole using an axial offset of the component from a distal end of the drilling assembly. The condition may be at least one of: i) accumulated fatigue of the component; and ii) estimated remaining useful life of the component. A spectrum of bending moment values may be divided into a number of mutually exclusive moment windows. Estimating the condition may include tracking a total estimated number of rotations wherein the component is subjected to bending moment values in a corresponding moment window. At least one selected window may be greater than a predetermined threshold bending moment. The method may further include associating a weight factor with at least one moment window; and using at least the weight factor and the total estimated number of rotations wherein the component is subjected to the bending moment values in the corresponding moment window to estimate the condition of the component. The method may further include estimating the condition of the component while conducting drilling operations in the borehole. The component may be at the bottom hole assembly.

System embodiments may include a drilling assembly configured to be conveyed into a borehole, the drilling assembly comprising at least one component; a first sensor associated with the drilling assembly and responsive to the depth of the component along the borehole; a second sensor associated with the drilling assembly and responsive to rotation of the component; and at least one processor. The processor may be configured to determine a depth of the component along the borehole using information from the first sensor; estimate a bending moment on the component at the depth; estimate a number of rotations of the component at the selected depth using information from the second sensor; and estimate the condition of the component using the estimated bending moment and the estimated number of rotations at the selected depth. The processor may be further configured to derive the estimated location of the component using an axial offset of the component from a distal end of the drilling assembly. The processor may be further configured to derive the estimated bending moment using an estimated deviation on a selected length of the borehole about the depth. The processor may be further configured to derive the estimated deviation from a borehole model. The processor may be further configured to separate a spectrum of bending moment values into a number of mutually exclusive moment windows, and track a total estimated number of rotations wherein the component is subjected to bending moment values in at least one selected moment window. The at least one selected window may be greater than a predetermined threshold bending moment. The processor may be further configured to associate a weight factor with the at least one selected moment window; and use at least the weight factor and the total estimated number of rotations wherein the component is subjected to the bending moment values in the corresponding moment window to estimate the condition of the component. The processor may be further configured to estimate the condition of the component before the component is removed from the borehole.

Other general embodiments may include a non-transitory computer-readable medium product for evaluating a condition of a downhole component of a drilling assembly in a borehole, the product accessible to at least one processor. The computer readable medium may include instructions that enable the at least one processor to carry out methods as described herein. The computer readable medium may include instructions that enable the at least one processor to: estimate a bending moment on the component at a selected depth along the borehole; estimate a number of rotations of the component at the selected depth; and estimate the condition of the component using the estimated bending moment and the estimated number of rotations at the selected depth.

Examples of features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1:
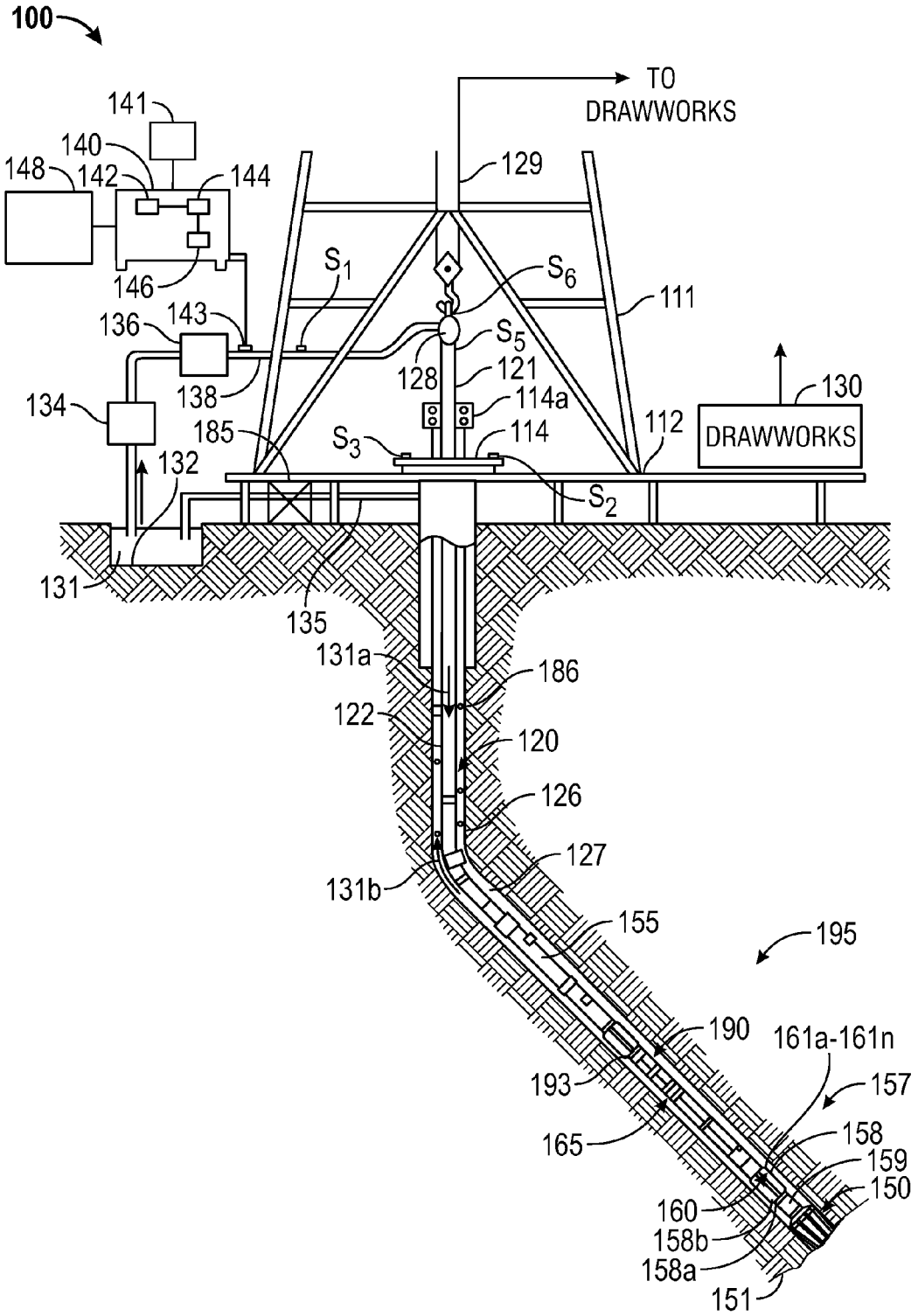
FIG. 1 shows a schematic diagram of an example drilling system in accordance with embodiments of the present disclosure for evaluating a condition of a downhole component of a drillstring.

In aspects, the present disclosure is related to evaluation of a condition of a downhole component of a drillstring in a borehole intersecting an earth formation. The present disclosure may be related to fatigue cycles on the component.

Downhole components of a drillstring may be subject to bending stresses in the borehole, especially during drilling operations (e.g., drilling, reaming, etc.). Deviations in the borehole (e.g., borehole curvature) may introduce bending moments on the components stemming from gravity and other forces and loads on the drillstring. These bending moments may cause bending stresses which are detrimental to the tool. For example, bending stresses resulting from deviation in the borehole may negatively affect the effective lifetime of the tool by fatiguing the component.

The bending moments (and, thus, the bending stresses) are dependent upon the trajectory of the borehole (e.g., borehole curvature). For example, borehole curvature with a greater dogleg severity introduces a greater bending moment than a borehole curvature with a lesser dogleg severity.

Moreover, the effect of fatigue caused by cyclical stresses on components of the drillstring may significantly limit the useful life of the component. Boreholes are drilled by rotating a drillbit attached at a distal end of a drillstring. Downhole components of the drillstring will also rotate during drilling operations. As the borehole deviates, at a particular point in time a first side of the drillstring about the deviation will experience compression, while the other side of the drillstring about the deviation will experience tension. Components making up the drillstring will experience corresponding compression or tension.

The nature of forces on components at a particular depth change as the drillstring rotates a component at that depth, such that if the component is rotated 180 degrees, the forces will be reversed—the first side will experience tension, while the other side will experience compression. As the drillstring continues to rotate, forces on the components may cycle through tension and compression at a rate corresponding with the angular velocity of the drillstring. This cyclical stress will cause eventual failure of a component, even when the component is otherwise used according to specification.

Cyclical stress is one of the most significant factors in estimating the component's condition. One characteristic relating to the component's condition is an estimated remaining useful life of the component. Estimated remaining useful life may be used to predict tool failure so the tool may be removed from use in the field for repair, reconditioning, or replacement prior to failure. Failure in the field is detrimental, because, for example, replacement during drilling operations is costly and time-consuming.

Previous techniques for estimating a condition of a component may use strain sensors on the component. However, strain sensors incorporated in the component may be costly and prone to error or mechanical failure. Such sensors may also take up valuable space on the drillstring and increase demands on power and transmission circuitry.

General embodiments of the present disclosure include methods, devices, and systems evaluating a condition of a downhole component of a drillstring in a borehole intersecting an earth formation. These embodiments may be directed to a single scale approach to estimating fatigue life based on bending—for example, by the evaluation of cyclical fatigue life of a drillstring component based on accumulation of bending cycles. Aspects of the disclosure are related to tracking cyclical stresses characterized by the estimated bending moment on the component and the number of cycles of stress under the bending moment. Methods may include estimating a bending moment on the component at a selected depth along the borehole; estimating a number of rotations of the component at the selected depth; and estimating the condition of the component using the estimated bending moment and the estimated number of rotations at the selected depth.

In some implementations, the above embodiments may be used as part of a drilling system. FIG. 1 shows a schematic diagram of an example drilling system in accordance with embodiments of the present disclosure for evaluating a condition of a downhole component of a drillstring. FIG. 1 shows a drillstring (drilling assembly) 120 that includes a bottomhole assembly (BHA) 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe 122), having the drillstring 190, attached at its bottom end extends from the surface to the bottom 151 of the borehole 126. A drillbit 150, attached to drillstring 190, disintegrates the geological formations when it is rotated to drill the borehole 126. The drillstring 120 is coupled to a drawworks 130 via a Kelly joint 121, swivel 128 and line 129 through a pulley. Drawworks 130 is operated to control the weight on bit ("WOB"). The drillstring 120 may be rotated by a top drive (not shown) instead of by the prime mover and the rotary table 114. Alternatively, a coiled-tubing may be used as the tubing 122. A tubing injector 114*a* may be used to convey the coiled-tubing having the drillstring attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drillstring 120 by a mud pump 134. The drilling fluid 131 passes from the mud pump 134 into the drillstring 120 via a desurger 136 and the fluid line 138. The drilling fluid 131*a* from the drilling tubular discharges at the borehole bottom 151 through openings in the drillbit 150. The returning drilling fluid 131*b* circulates uphole through the annular space 127 between the drillstring 120 and the borehole 126 and returns to the mud pit 132 via a return line 135 and drill cutting screen 185 that removes the drill cuttings 186 from the returning drilling fluid 131*b*. A sensor S1 in line 138 provides information about the fluid flow rate. A surface torque sensor S2 and a sensor S3 associated with the drillstring 120 may respectively provide information about the torque and the rotational speed of the drillstring 120. Tubing injection speed is determined from the sensor S5, while the sensor S6 provides the hook load of the drillstring 120.

In some applications, the drillbit 150 is rotated by only rotating the drill pipe 122. However, in many other applications, a downhole motor 155 (mud motor) disposed in the drillstring 190 also rotates the drillbit 150. The rate of penetration (ROP) for a given BHA largely depends on the WOB or the thrust force on the drillbit 150 and its rotational speed.

The mud motor 155 is coupled to the drillbit 150 via a drive shaft disposed in a bearing assembly 157. The mud motor 155 rotates the drillbit 150 when the drilling fluid 131 passes through the mud motor 155 under pressure. The bearing assembly 157, in one aspect, supports the radial and axial forces of the drillbit 150, the down-thrust of the mud motor 155 and the reactive upward loading from the applied weight-on-bit.

A surface control unit or controller 140 receives signals from the downhole sensors and devices via a sensor 143 placed in the fluid line 138 and signals from sensors S1-S6 and other sensors used in the system 100 and processes such signals according to programmed instructions provided to the surface control unit 140. The surface control unit 140 displays desired drilling parameters and other information on a display/monitor 141 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices. The data may be transmitted in analog or digital form.

The BHA 190 may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, formation pressures, properties or characteristics of the fluids downhole and other desired properties of the formation 195 surrounding the BHA 190. Such sensors are generally known in the art and for convenience are generally denoted herein by numeral 165. The BHA 190 may further include a variety of other sensors and devices 159 for determining one or more properties of the BHA 190 (such as vibration, acceleration, oscillations, whirl, stick-slip, etc.) and drilling operating parameters, such as weight-on-bit, fluid flow rate, pressure, temperature, rate of penetration, azimuth, tool face, drillbit rotation, etc.) For convenience, all such sensors are denoted by numeral 159.

The BHA 190 may include a steering apparatus or tool 158 for steering the drillbit 150 along a desired drilling path. In one aspect, the steering apparatus may include a steering unit 160, having a number of force application members 161*a*-161*n*, wherein the steering unit is at partially integrated into the drilling motor. In another embodiment the steering apparatus may include a steering unit 158 having a bent sub and a first steering device 158*a* to orient the bent sub in the wellbore and the second steering device 158*b* to maintain the bent sub along a selected drilling direction.

The drilling system 100 may include sensors, circuitry and processing software and algorithms for providing information about desired dynamic drilling parameters relating to the BHA, drillstring, the drillbit and downhole equipment such as a drilling motor, steering unit, thrusters, etc. Exemplary sensors include, but are not limited to drillbit sensors, an RPM sensor, a weight on bit sensor, sensors for measuring mud motor parameters (e.g., mud motor stator temperature, differential pressure across a mud motor, and fluid flow rate through a mud motor), and sensors for measuring acceleration, vibration, whirl, radial displacement, stick-slip, torque, shock, vibration, bit bounce, axial thrust, friction, backward rotation, and radial thrust. Sensors distributed along the drillstring can measure physical quantities such as drillstring acceleration, internal pressures in the drillstring bore, external pressure in the annulus, vibration, temperature, electrical and magnetic field intensities inside the drillstring, bore of the drillstring, etc. Suitable systems for making dynamic downhole measurements include COPILOT, a downhole measurement system, manufactured by BAKER HUGHES INCORPORATED.

The drilling system 100 can include one or more downhole processors at a suitable location such as 193 on the BHA 190. The processor(s) can be a microprocessor that uses a computer program implemented on a suitable non-transitory computer-readable medium that enables the processor to perform the control and processing. The non-transitory computer-readable medium may include one or more ROMs, EPROMs, EAROMs, EEPROMs, Flash Memories, RAMs, Hard Drives and/or Optical disks. Other equipment such as power and data buses, power supplies, and the like will be apparent to one skilled in the art. In one embodiment, the MWD system utilizes mud pulse telemetry to communicate data from a downhole location to the surface while drilling operations take place. The surface processor 142 can process the surface measured data, along with the data transmitted from the downhole processor, to evaluate a condition of drillstring components. While a drillstring 120 is shown as a conveyance system for sensors 165, it should be understood that embodiments of the present disclosure may be used in connection with tools conveyed via rigid (e.g. jointed tubular or coiled tubing) as well as non-rigid (e. g. wireline, slickline, e-line, etc.) conveyance systems. The drilling system 100 may include a bottomhole assembly and/or sensors and equipment for implementation of embodiments of the present disclosure. A point of novelty of the system illustrated in FIG. 1 is that the surface processor 142 and/or the downhole processor 193 are configured to perform certain methods (discussed below) that are not in the prior art. While a drillstring is shown for convenience, it should be understood that embodiments of the present disclosure may be used in connection with tools conveyed via any type of rigid (e.g. jointed tubular or coiled tubing) conveyance system.

Aspects of the present disclosure relate to estimating a number of rotational cycles of a component at an estimated bending moment. Estimating the bending moment on the component may be carried out using a model of the borehole. Modeling may also be carried out using information derived from measurements from the surface (e.g., seismic), from the BHA 190 (e.g., resistivity, borehole acoustic, nuclear), or from other boreholes drilled in the same or similar formations (e.g., offset wells), and so on. Modeling the borehole may be carried out using instruments related to geosteering, or to azimuth and inclination measuring devices generally, or to detection of formation features modeled using known or predicted lithologies of the formation and its geophysical characteristics, and thus may be modeled or updated in real-time (i.e., during drilling operations, before removal of the tool from the wellbore, etc.).

A configuration of the drillstring may be predicted using the model and an estimation of the location of the component within the borehole. Estimating the location of the component may be carried out using the model and determining the position of the component via a known position of the component in relation to the drillbit. Borehole depth of the drillbit may be determined using the sensors above according to methods known in the art. Tracking the number of rotational cycles at a particular depth may be carried out using sensors on the component or the drillstring to determine the revolutions per minute ('RPM') or other rotational measurements.

Figure 2A:
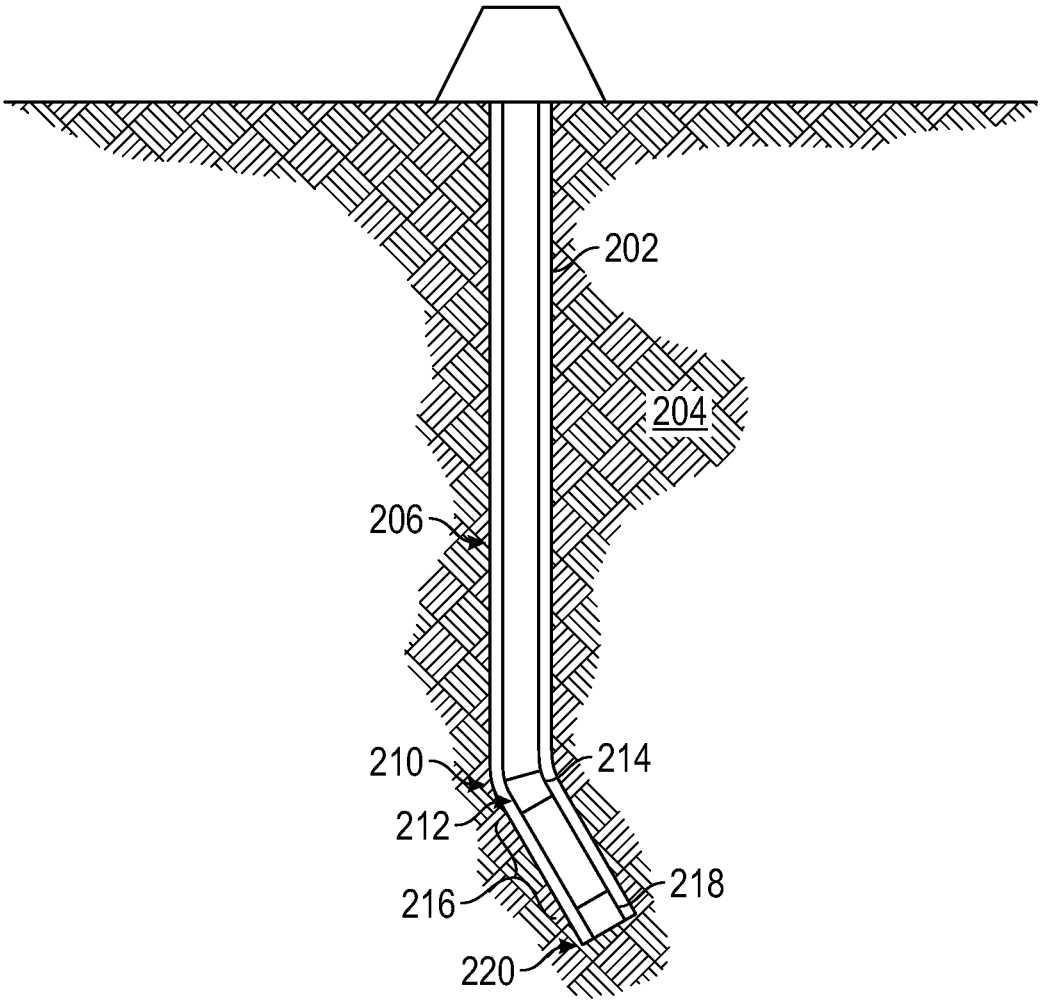
FIGS. 2A-2E show a drillstring in a borehole in accordance with embodiments of the present disclosure.

FIGS. 2A-2E show a drillstring in a borehole in accordance with embodiments of the present disclosure. FIG. 2A illustrates a two dimensional representation of a model of the borehole 202 accounting for a deviation 210. The borehole 202 is drilled by rotating a drillbit 218 on the distal end of a drillstring 206. Component 214 is at a particular borehole depth. Borehole 202, via deviation 210, imparts a bending moment on component 214. Determining a bending moment on the component may be carried out by determining a bending moment on the drillstring or the particular component 214 at a selected borehole depth 212. The selected borehole depth may correspond to a known distance 216 uphole from the borehole depth 220 of the drillbit 218. Known distance 216 may be predetermined according to tool specifications, and thus, may be known before the drillstring is positioned in the borehole 202. Borehole depth 220 of the drillbit 218 and the configuration of the borehole may be estimated using various methodologies well known to those of skill in the art, such as, for example, borehole depth (e.g., spool depth), true value depth ('TVD'), accelerometers or magnetometers on the BHA 190, a relation to modeled features of the borehole derived via sensors on the BHA, and so on.

Figure 2B:
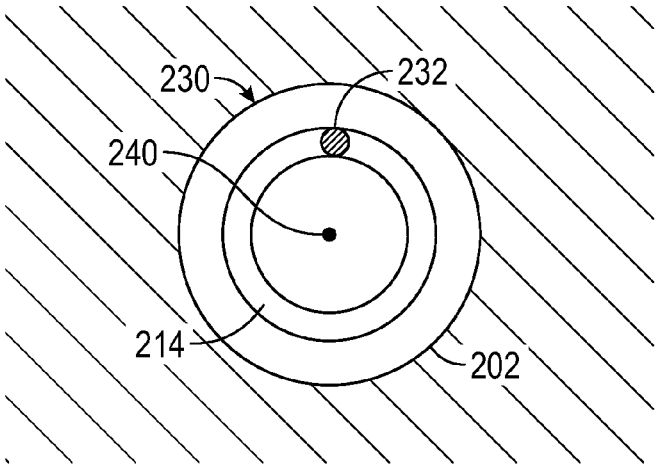
Figure 2C:
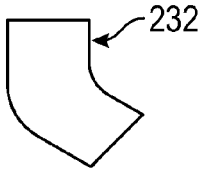
Figure 2D:
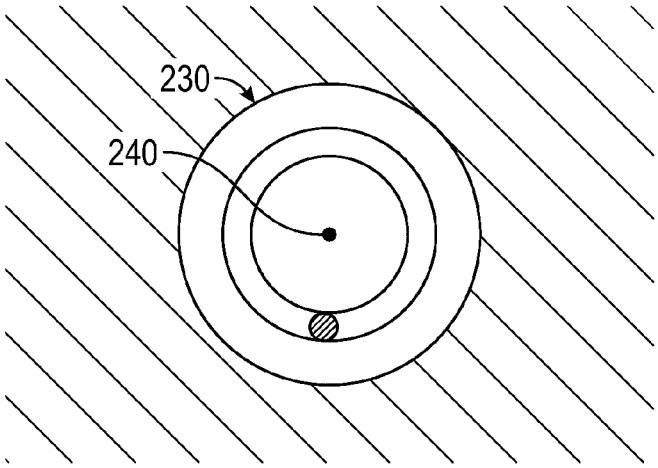
Figure 2E:
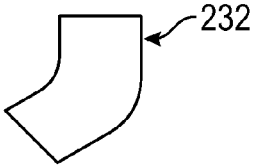

FIG. 2B shows a cylindrical component of a drillstring in accordance with embodiments of the present disclosure. Component 214 is positioned in borehole 202 at the selected borehole depth 212 and rotating with a period $\tau$ about an axis of rotation 240. At a first point in time (t=0), the component 214 is oriented with a first point 232 of the component 214 at the high side of the borehole 230. As is readily apparent in FIG. 2C, the side of the component 214 corresponding with the first point 232 experiences compression at this point in the rotation. FIG. 2D shows the same cylindrical component at a point in time ($t=\tau/2$), wherein the first point 232 of the component 214 is oriented 180 degrees from the high side of the borehole 230, and the side of the component 214 corresponding with the first point 232 experiences tension (FIG. 2E). Although a cylindrical component is shown for convenience, it is anticipated that not all components will be cylindrical. Indeed, some components may be irregular in shape, or may be mounted only on one side of the drillstring, such as, for example, adjacent to first point 232. The techniques of the present disclosure may be used on any such component that experiences cyclical stresses coinciding with rotation downhole.

Figure 3:
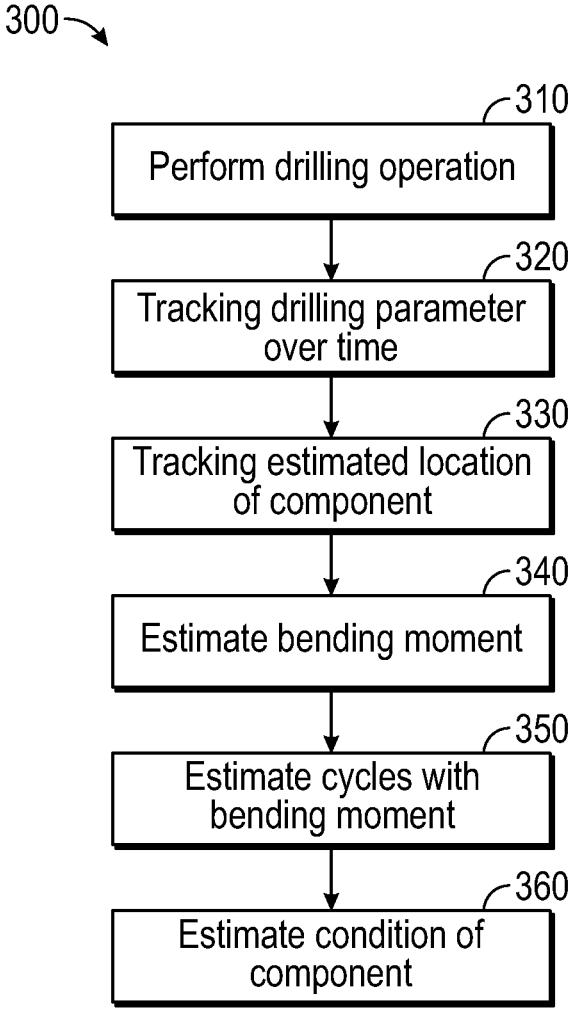
FIG. 3 is a flow chart illustrating methods for evaluating a condition of a component in accordance with embodiments of the present disclosure.

FIG. 3 is a flow chart illustrating methods for evaluating a condition of a component in accordance with embodiments of the present disclosure. Optional step 310 of the method 300 may include performing a drilling operation in a borehole. For example, a drillstring may be used to form (e.g., drill) the borehole. Optional step 320 of the method 300 may include tracking a drilling parameter (e.g., RPM) over time, such as, for example, by using time-dependent measurements from sensors associated with the drillstring. Optionally, at step 330, the method may include tracking an estimated location of the component in the borehole. Tracking the estimated location may comprise knowledge of the component location at all times the component is in the borehole. Optional step 330 may be carried out by deriving the estimated location of the component in the borehole using an estimated location of the drillbit in the borehole and an offset of the component from the drillbit. The drillbit location may be continuously tracked using various methods (such as using suitable rotating azimuth ('ROTAZ') and borehole depth measurements) and retrieved as needed. For example, a 1-foot increment export of the actual well path from a software suite such as WellArchitect™ by Dynamic Graphics, Inc may be used.

For example, step 330 may be carried out using an axial offset of the component from a distal end of the drillstring. This axial offset may be less than the length of a standard drill pipe segment. Thus, an estimate of the component position downhole at any time may be calculated, for example, by subtracting the offset from borehole depth. The axial offset may be selected to determine stresses at an axial location in the component known to have a significant likelihood of failure.

Step 340 may include estimating a bending moment on the component. Estimating the bending moment may include using an estimated borehole configuration and an estimated location of the component in the borehole. Step 340 may be carried out by estimating a bending moment on the component at a selected depth along the borehole, which may include deriving the estimated bending moment using an estimated deviation on a selected length of the borehole about the selected depth. The estimated deviation may be expressed as dogleg severity, for example.

A correlation may be derived between static bending moment and dogleg severity for a specific component (e.g., bottomhole assembly). Strain or bending measurements may be taken or modeled with respect to DLS, such as, for example, using finite element modeling. The correlation may be employed to assign bending moment to a dogleg severity measurement.

Step 350 may include accounting for a number of cycles of stress the component experiences with a particular bending moment. Step 350 may be carried out by estimating a number of rotations of the component at the selected depth. RPM and bit depth may be associated, such as, for example, by using time-dependent measurements. Cycles at each depth may be calculated as $RPM*\Delta t/60$, wherein $\Delta t$ is in seconds. In some embodiments, a database or file associating the two parameters may be used to estimate rotations at each station. DLS, bending moment, and rotations may be associated with every depth position of the component using look-up tables or the like.

The number of rotations at a particular selected depth may be tracked at each particular depth at a resolution consistent with measurement granularity, or may be grouped together into bins or windows of selected intervals of borehole depth. Likewise, the particular bending moment may be tracked at a resolution consistent with measurement granularity, or may be grouped together into bins or windows of selected ranges of bending moment, as discussed further with reference to FIGS. 4A-4B and 5 below. Thus, estimating the condition may include tracking a total estimated number of rotations wherein the component is subjected to bending moment values in a corresponding moment window.

Figure 4A:
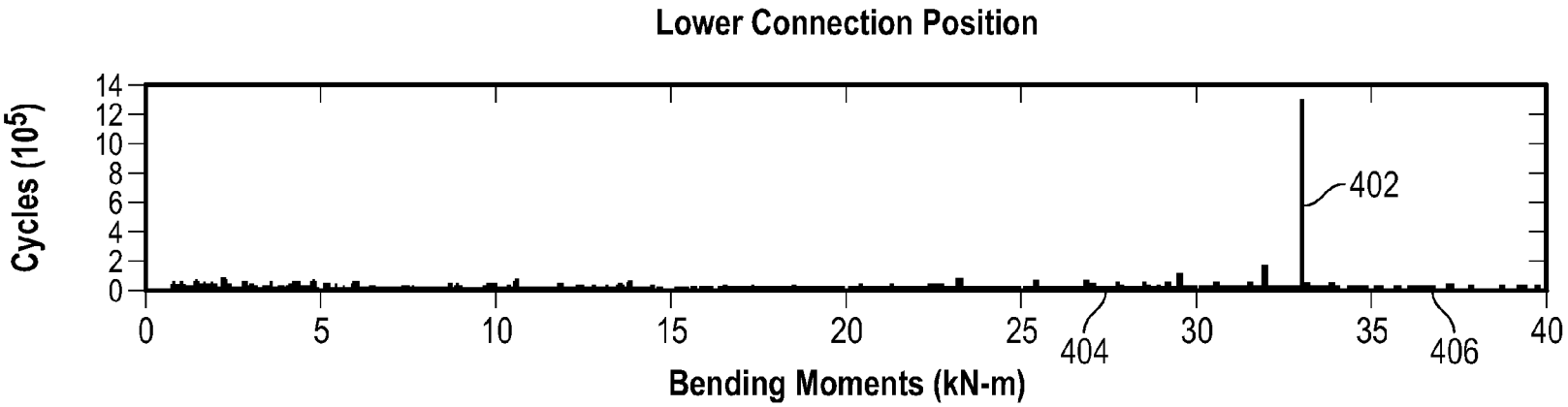
FIG. 4A illustrates a distribution of cycles (e.g., rotations) of the component with respect to specific bending moments.
Figure 4B:
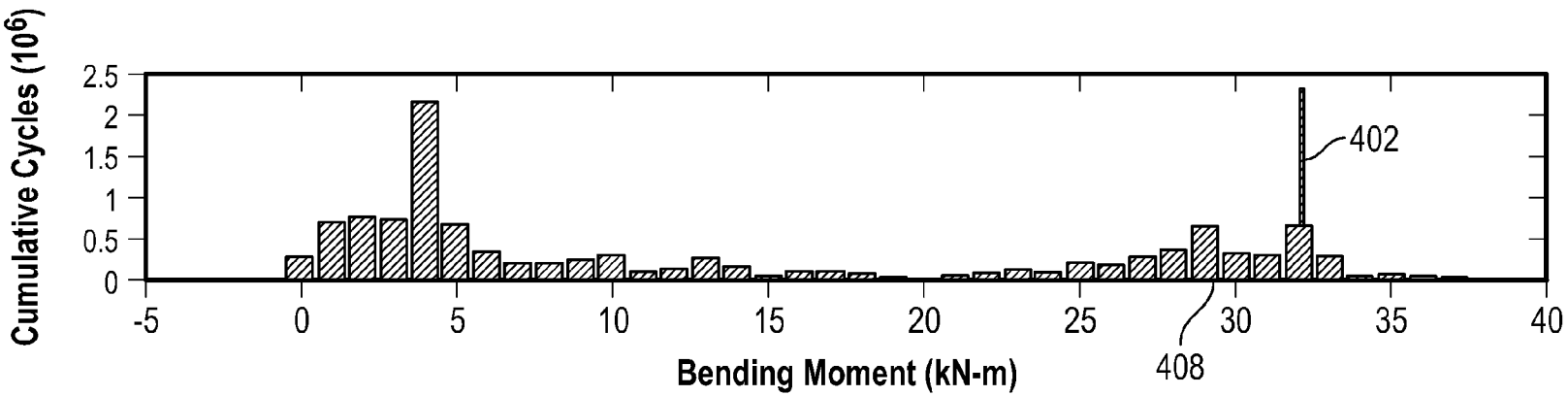
FIG. 4B illustrates a grouping of the above cycles in corresponding bins.

FIG. 4A illustrates a distribution of cycles (e.g., rotations) of the component with respect to specific bending moments. Heightened significance may be attributed to cycles at bending moments above a threshold bending limit 402 of the component. Cycles 404 at or below the threshold bending limit 402 may be less likely to significantly reduce component life, while cycles 406 above the threshold bending limit 402 may be more likely to significantly reduce component life. FIG. 4B illustrates a grouping of the above cycles in corresponding bins 408. The bending moment values corresponding with each bin may be exclusive to the bin, or may overlap.

Returning to FIG. 3, in step 360, the condition of the component is estimated using information indicative of cyclical stresses. Step 360 may include estimating the condition of the component using the estimated bending moment on the component at the selected depth and the estimated number of rotations of the component at the selected depth.

Estimating the condition of the component may be carried out by tracking the cumulative number of cycles (rotations) above a threshold bending limit and comparing the cumulative number of cycles against an upper limit. In some instances, the threshold bending limit may represent substantially any bending. In other embodiments, the threshold bending limit may be set to indicate substantial damage. More than one threshold bending limit may be used, with cumulative cycles tracked for each.

For example, it may be determined that a component may be rotated up to 20,000,000 cycles at a bending moment above the threshold bending limit before showing signs of plastic deformation. An estimated remaining component life may be derived by summing all of the cycles above the limit and subtracting from an upper limit of 20,000,000. This total may be divided by 20,000,000 and multiplied by 100 to determine the estimated percentage of remaining useful life of the component. Using the data of FIGS. 4A-4B, 493,000 cycles have been consumed, for an estimated 98 percent of useful life remaining.

Step 360 may also include associating a weight factor with at least one moment window; and using at least the weight factor and the total estimated number of rotations wherein the component is subjected to the bending moment values in the corresponding moment window to estimate the condition of the component.

Figure 5:
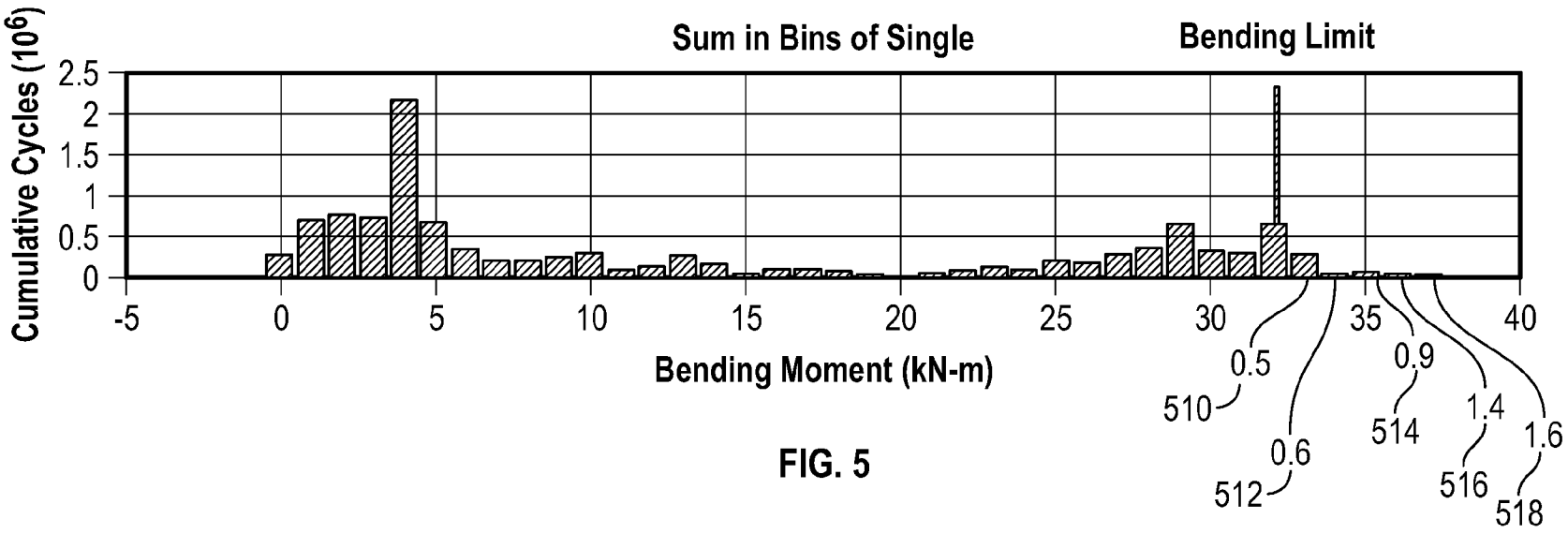
FIG. 5 illustrates a weighting of grouped cycles in corresponding bins.

Referring to FIG. 5, each window, or bin, 510-518 above the threshold bending limit 502 may be weighted. More specifically, in tracking the cumulative cycles, the cycles associated with each bin 510-518 are weighted. Weighting may be determined using various empirical methods, computer assisted history matching, neural networks, and so on. For example, using simulation or experimental results an artificial neural network can be trained to quickly determine correct weighting for each component. Artificial neural networks may also be used to determine bending moments of a component at a selected borehole depth.

In the embodiment of FIG. 5, in step 360, cumulative cycles in bin 510 are multiplied by 0.5; cumulative cycles in bin 512 are multiplied by 0.6; cumulative cycles in bin 514 are multiplied by 0.9; cumulative cycles in bin 516 are multiplied by 1.1; and cumulative cycles in bin 518 are multiplied by 1.6. The sum of the product of the cumulative number of cycles in each bin and the weight associated with the corresponding bin may be compared to an upper limit. In other embodiments, each bin in the spectrum may be tabulated and weighted.

The term "conveyance device" as used above means any device, device component, combination of devices, media and/or member that may be used to convey, house, support or otherwise facilitate the use of another device, device component, combination of devices, media and/or member. Exemplary non-limiting conveyance devices include drillstrings of the coiled tube type, of the jointed pipe type and any combination or portion thereof. Other conveyance device examples include casing pipes, wirelines, wire line sondes, slickline sondes, drop shots, downhole subs, BHA's, drillstring inserts, modules, internal housings and substrate portions thereof, self-propelled tractors. The term "information" as used above includes any form of information (analog, digital, EM, printed, etc.). The term "information processing device" herein includes, but is not limited to, any device that transmits, receives, manipulates, converts, calculates, modulates, transposes, carries, stores or otherwise utilizes information. An information processing device may include a microprocessor, resident memory, and peripherals for executing programmed instructions.

The term "component" as used above means any device, device component, combination of devices, housings, members, mandrels, and so on that may be replaceable (alone or as part of an assembly) on a drillstring and used downhole. By "substantially any bending," it is meant bending sufficiently large enough to appreciably affect the useful life of the component, examples of such a bending including a rate of, for example, larger than 5 cm per 30 meters, 3 cm per 30 meters, 1 cm per 30 meters, 1 mm per 30 meters, and so on.

In some embodiments, estimation of the condition of the component may involve applying a model. The model may include, but is not limited to, (i) a mathematical equation, (ii) an algorithm, (iii) a database of associated parameters, (iv) an array, or a combination thereof which describes physical characteristics of the borehole.

While the present disclosure is discussed in the context of a hydrocarbon producing well, it should be understood that the present disclosure may be used in any borehole environment (e.g., a water or geothermal well). It should be noted that the terms wellbore and borehole are used interchangeably.

The present disclosure is susceptible to embodiments of different forms. There are shown in the drawings, and herein are described in detail, specific embodiments of the present disclosure with the understanding that the present disclosure is to be considered an exemplification of the principles of the disclosure and is not intended to limit the disclosure to that illustrated and described herein. While the foregoing disclosure is directed to the one mode embodiments of the disclosure, various modifications will be apparent to those skilled in the art. It is intended that all variations be embraced by the foregoing disclosure.

We claim:

1. A method for evaluating a condition of a downhole component of a drilling assembly in a borehole, the method comprising:

estimating a bending moment on the component at a selected depth along the borehole;

determining a number rotations of the component at the selected depth;

associating the number of rotations of the component at the selected depth with the bending moment on the component at the selected depth; and estimating the condition of the component using the number of rotations at the bending moment;

wherein a spectrum of bending moment values is divided into a number of mutually exclusive moment windows, and wherein estimating the condition comprises tracking a total estimated number of rotations wherein the component is subjected to bending moment values in a corresponding moment window;

wherein the condition is at least one of: i) accumulated fatigue of the component; and ii) estimated remaining useful life of the component.

2. The method of claim 1 further comprising deriving the estimated bending moment using an estimated deviation on a selected length of the borehole about the selected depth.

3. The method of claim 2 further comprising deriving the estimated deviation from a borehole model.

4. The method of claim 1, wherein the method further comprises deriving an estimated location of the component in the borehole using an axial offset of the component from a distal end of the drilling assembly.

5. The method of claim 1, wherein at least one selected window is greater than a predetermined threshold bending moment.

6. The method of claim 1, further comprising:

associating a weight factor with at least one moment window; and using at least the weight factor and the total estimated number of rotations wherein the component is subjected to the bending moment values in the corresponding moment window to estimate the condition of the component.

7. The method of claim 1, further comprising estimating the condition of the component while conducting drilling operations in the borehole.

8. The method of claim 1 further comprising:

deriving the estimated bending moment from a borehole model using an estimated deviation on a selected length of the borehole about the selected depth and dimensions of the component; and deriving an estimated location of the component in the borehole using an axial offset of the component from a distal end of the drilling assembly;

wherein a spectrum of bending moment values is divided into a number of mutually exclusive moment windows, and estimating the condition comprises tracking a total estimated number of rotations wherein the component is subjected to bending moment values in a corresponding moment window and wherein at least one selected window is greater than a predetermined threshold bending moment; and wherein the component is at the bottom hole assembly and the condition is at least one of: i) accumulated fatigue of the component; and ii) estimated remaining useful life of the component.

9. A system for conducting drilling operations, the system comprising:

a drilling assembly configured to be conveyed into a borehole, the drilling assembly comprising at least one component;

a first sensor associated with the drilling assembly and responsive to a depth of the component along the borehole;

a second sensor associated with the drilling assembly and responsive to rotation of the component; and at least one processor configured to:

determine a depth of the component along the borehole using information from the first sensor;

estimate a bending moment on the component at the depth;

determine a number of rotations of the component at the selected depth using information from the second sensor;

associate the number of rotations of the component at the selected depth with the bending moment on the component at the selected depth; and estimate the condition of the component using the number of rotations at the bending moment;

wherein the processor is further configured to separate a spectrum of bending moment values into a number of mutually exclusive moment windows, and track a total estimated number of rotations wherein the component is subjected to bending moment values in at least one selected moment window;

wherein the condition is at least one of: i) accumulated fatigue of the component; and ii) estimated remaining useful life of the component.

10. The system of claim 9, wherein the processor is further configured to derive an estimated location of the component using an axial offset of the component from a distal end of the drilling assembly.

11. The system of claim 9, wherein the processor is further configured to derive the estimated bending moment using an estimated deviation on a selected length of the borehole about the depth.

12. The system of claim 11, wherein the processor is further configured to derive the estimated deviation from a borehole model.

13. The method of claim 9, wherein the at least one selected window is greater than a predetermined threshold bending moment.

14. The method of claim 9, wherein the processor is further configured to:

associate a weight factor with the at least one selected moment window; and use at least the weight factor and the total estimated number of rotations wherein the component is subjected to the bending moment values in the corresponding moment window to estimate the condition of the component.

15. The system of claim 9, wherein the processor is further configured to estimate the condition of the component before the component is removed from the borehole.

* * * * *